US006032946A

United States Patent [19]

Marshall et al.

[11] Patent Number: 6,032,946

[45] Date of Patent: Mar. 7, 2000

[54] DOCUMENT FEEDER

[75] Inventors: Gary R. Marshall; Alexander S. Murison, both of Waterloo, Canada

[73] Assignee: NCR Corporation, Dayton, Ohio

[21] Appl. No.: 08/994,696

[22] Filed: Dec. 19, 1997

[51] Int. Cl.[7] ..... B65H 1/18

[52] U.S. Cl. ..... 271/152; 271/153; 271/154

[58] Field of Search ..... 271/152, 153, 271/154, 155, 126

[56] References Cited

U.S. PATENT DOCUMENTS

| | | | |
|---|---|---|---|
| 3,894,732 | 7/1975 | Muller | 271/153 |
| 4,919,412 | 4/1990 | Weigel et al. | 271/152 |
| 5,104,109 | 4/1992 | Kubo | 271/152 |
| 5,167,408 | 12/1992 | Golicz | 271/152 |
| 5,653,434 | 8/1997 | Petochi et al. | 271/152 |
| 5,722,653 | 3/1998 | Seidl et al. | 271/153 |
| 5,848,786 | 12/1998 | Holland-Letz et al. | 271/152 |
| 5,899,448 | 4/1999 | Hosking | 271/3.08 |

FOREIGN PATENT DOCUMENTS

| | | | |
|---|---|---|---|
| 360067334 | 4/1985 | Japan | 271/152 |
| 403133840 | 6/1991 | Japan | 271/152 |
| 403243537 | 10/1991 | Japan | 271/152 |

*Primary Examiner*—Christopher P. Ellis
*Assistant Examiner*—Khoi H. Tran
*Attorney, Agent, or Firm*—Michael Chan

[57] ABSTRACT

A document feeder comprises a tray for containing a stack of documents to be fed along a document feed path. A picker mechanism picks a document from the stack and moves the picked document along the document feed path. A controllable motivator disposed in the tray is provided for, when controlled, applying a variable force against the stack to move the stack against the picker mechanism to allow the picker mechanism to pick a document from the stack and move the picked document along the document feed path. The picker mechanism includes a pre-picker roller having an outer circumferential surface which engages a document in the stack to initially pick the engaged document and move the picked document into the document feed path. First and second interruptive sensors cooperate to sense position of the picking mechanism relative to the stack. A controller responsive to output signals from the first and second sensors controls the motivator to apply a force against the stack such that the stack applies a relatively constant force against the outer circumferential surface of the pre-picker roller. Both sensors are uninterrupted when the stack applies an amount of force less than a desired amount of force against the outer circumferential surface of the pre-picker roller. One sensor is interrupted and the other sensor is uninterrupted when the stack applies a desired amount of force against the outer circumferential surface of the pre-picker roller. Both sensors are interrupted when the stack applies an amount of force greater than a desired amount of force against the outer circumferential surface of the pre-picker roller.

11 Claims, 3 Drawing Sheets

DOCUMENT FEEDER

BACKGROUND OF THE INVENTION

The present invention relates to document feeding along a document feed path, and is particularly directed to a document feeder for feeding a document along a document feed path in a document processing system such as a bank check processing system.

Many different types of document feeders are known. Some known document feeders include a document feeder tray of the inclined type in which a stack of documents to be fed to a document feeding mechanism is placed on an inclined surface. The document feeding mechanism processes the stack of documents by picking the documents one-by-one from a lower end position of the stack of documents. Typically, a weight resting on the stack of documents rolls or slides along the inclined surface to advance the stack of documents towards the document feeding mechanism. A disadvantage in using a document feeder tray of the inclined type is that the weight of the stack of documents varies with the size of the stack. As the documents are being fed, the size of the stack decreases. Accordingly, the weight of the stack decreases as documents are being fed.

Another known type of document feeder tray is of the horizontal type in which a stack of documents to be fed to a document feeding mechanism is placed on a horizontal surface. The document feeding mechanism processes the stack of documents by picking the documents one-by-one from one end of the stack of documents. Typically, a spring-biased plate is disposed at the other end of the stack of documents to advance the stack of documents towards the document feeding mechanism. A disadvantage in using a document feeder tray of the horizontal type and a spring-biased plate which advances a stack of documents contained in the document feeder tray is that the spring characteristics change over time due to normal wear and tear of the spring.

SUMMARY OF THE INVENTION

In accordance with one aspect of the present invention, a document feeder is provided for feeding documents along a document feed path. The document feeder comprises a tray for containing a stack of documents to be fed along the document feed path. A picker mechanism is provided for picking a document from the stack of documents stored in the tray and moving the picked document along the document feed path. Sensing means is provided for sensing position of the picking mechanism relative to the stack of documents. Control means responsive to the sensing means is provided for applying a force against the stack of documents such that the stack applies a relatively constant force against the picker mechanism as the picker mechanism picks documents from the stack and moves picked documents along the document feed path.

Preferably, the sensing means includes a pair of interruptive sensors which cooperate to sense position of the picking mechanism relative to the stack of documents. Both interruptive sensors are uninterrupted when the stack applies an amount of force less than a desired amount of force against the picker mechanism. One interruptive sensor is interrupted and the other interruptive sensor is uninterrupted when the stack applies a desired amount of force against the picker mechanism. Both interruptive sensors are interrupted when the stack applies an amount of force greater than a desired amount of force against the picker mechanism. The control means includes a tray motivator for applying a force against the stack. The control means also includes a controller for controlling the tray motivator to apply a force against the stack which varies as a function of the number of interruptive sensors interrupted.

In accordance with another aspect of the present invention, a document feeder is provided for feeding documents along a document feed path. The document feeder comprises a tray for containing a stack of documents to be fed along the document feed path. A picker mechanism is provided for picking a document from the stack of documents stored in the tray and moving the picked document along the document feed path. A controllable motivator disposed in the tray is provided for, when controlled, applying a variable force against the stack of documents to move the stack against the picker mechanism to allow the picker mechanism to pick a document from the stack and move the picked document along the document feed path. First and second interruptive sensors cooperate to sense position of the picking mechanism relative to the stack of documents. A controller responsive to output signals from the first and second sensors is provided for controlling the motivator to apply a force against the stack of documents such that the stack applies a relatively constant force against the picker mechanism as the picker mechanism picks documents from the stack and moves picked documents along the document feed path.

Preferably, the picker mechanism includes a pre-picker roller having a longitudinal central axis and an outer circumferential surface which engages a document in the stack of documents to initially pick the engaged document and move the picked document into the document feed path as the pre-picker roller rotates about its longitudinal central axis. The picker mechanism further includes a picker roller having a longitudinal central axis and an outer circumferential surface which engages a document which has been picked and moved into the document feed path by the pre-picker roller. Both interruptive sensors are uninterrupted when the stack applies an amount of force less than a desired amount of force against the outer circumferential surface of the pre-picker roller, (ii) one interruptive sensor is interrupted and the other interruptive sensor is uninterrupted when the stack applies a desired amount of force against the outer circumferential surface of the pre-picker roller, and (iii) both interruptive sensors are interrupted when the stack applies an amount of force greater than a desired amount of force against the outer circumferential surface of the pre-picker roller.

BRIEF DESCRIPTION OF THE DRAWINGS

The foregoing and other features of the present invention will become apparent to one skilled in the art to which the present invention relates upon consideration of the following description of the invention with reference to the accompanying drawings, wherein.

DETAILS OF THE INVENTION

Figure 1:
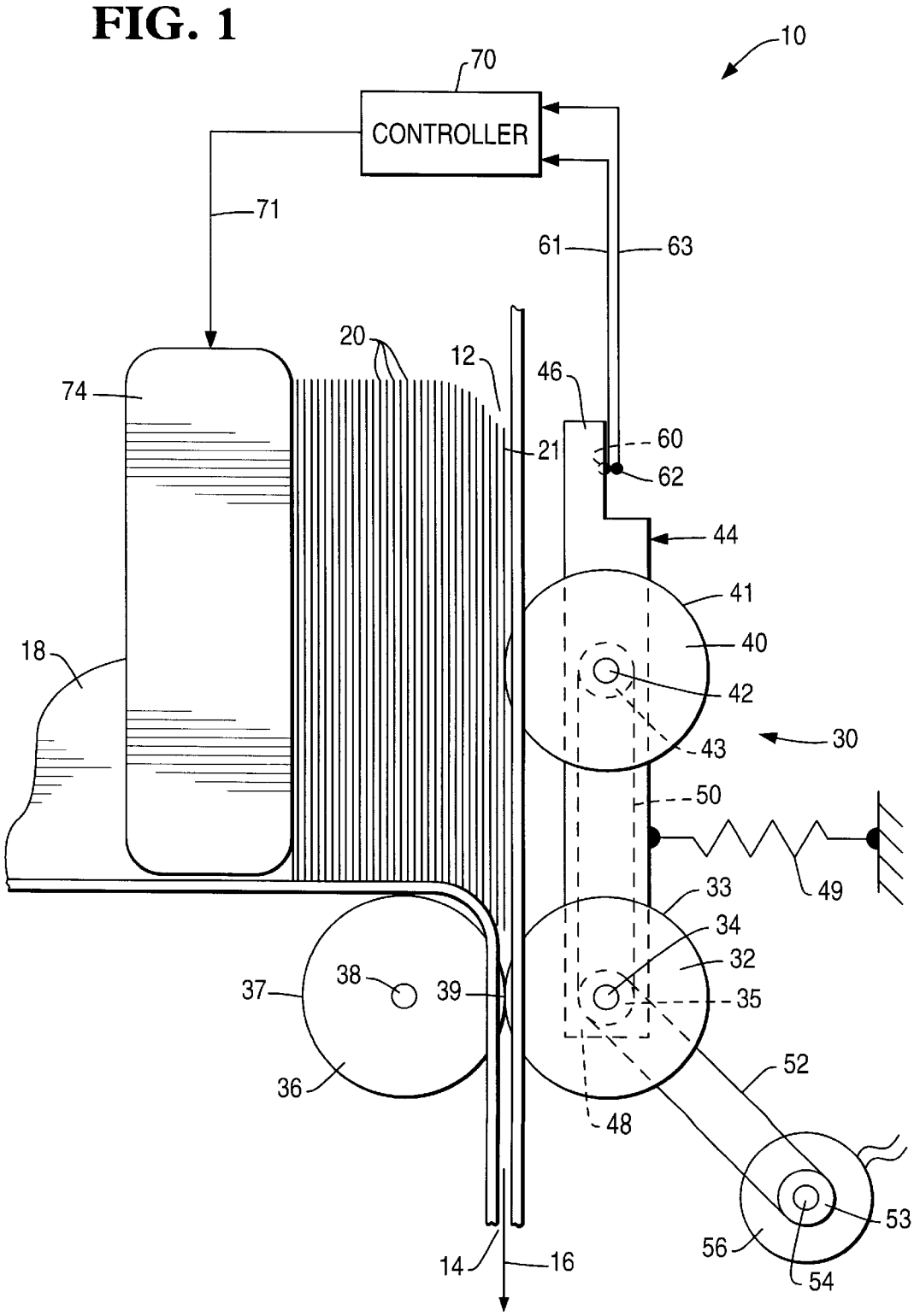
FIG. 1 is a schematic view of a document feeder constructed in accordance with the present invention.

The present invention is directed to a document feeder which feeds documents one-by-one from a stack of documents along a document feed path of a document processing system. The specific use and construction of the present invention may vary. By way of example as shown in FIG. 1, a document feeder constructed in accordance with the present invention is embodied in a document processing system 10 such as a check processing system.

The document processing system 10 has an upstream end 12, a downstream end 14, and a document feed path 16 defined between the upstream end 12 and the downstream end 14. A document feeder tray 18 for containing a stack 20 of documents is located along the document feeding path 16. An end sheet 21 of the stack 20 lies in the document feeding path 16 at the upstream end 12.

A picker mechanism 30 includes a picker roller 32 having a longitudinal central axis and an outer circumferential surface 33. The picker roller 32 is rotatably mounted on a first shaft 34 for rotation about its longitudinal central axis. The picker roller 32 is fixedly attached to a toothed wheel 35 located beneath the picker roller 32. A retard roller 36 is adjacent to the document feed path 16 and lies opposite the picker roller 32. The retard roller 36 has a longitudinal central axis and an outer circumferential surface 37. The retard roller 36 is rotatably mounted on a second shaft 38 for rotation about its longitudinal central axis. A contact point 39 is defined between the outer circumferential surface 33 of the picker roller 32 and the outer circumferential surface 37 of the retard roller 36.

The picker mechanism 30 also includes a pre-picker roller 40 having a longitudinal central axis and an outer circumferential surface 41. The pre-picker roller 40 is rotatably mounted on a third shaft 42 for rotation about its longitudinal central axis. The pre-picker roller 40 is fixedly attached to a toothed wheel 43 located beneath the pre-picker roller 40 as viewed in FIG. 1. The third shaft 42 is fixedly attached to an arm member 44 at an intermediate location of the arm member as shown in FIG. 1. The arm member 44 has a free end 46 and a fixed end 48 which is pivotably mounted on the first shaft 34. A biasing spring 49 is coupled to the arm member 44 such that the pre-picker roller 40 is biased against the end sheet 21 of the stack 20 of documents.

A first drive belt 50 is drivingly connected between the toothed wheel 35 associated with the picker roller 32 and the toothed wheel 43 associated with the pre-picker roller 40. A second drive belt 52 is drivingly connected between the toothed wheel 35 associated with the picker roller 32 a toothed wheel 53 fixedly attached to and an output shaft 54 of a drive motor 56. When the output shaft 54 of the drive motor 56 rotates in the counterclockwise direction (as viewed in FIG. 1), the first shaft 34 and the third shaft 42 are driven for rotation in the counterclockwise direction. Accordingly, the picker roller 32 and the pre-picker roller 40 are driven for rotation in the counterclockwise direction.

When the pre-picker roller 40 rotates in the counterclockwise direction, the end sheet 21 of the stack 20 of documents is transported along the document feed path 16 from the upstream end 12 towards the downstream end 14 due to friction between the end sheet and the outer circumferential surface 41 of the pre-picker roller 40. The end sheet 21 is transported along the document feed path 16 into the contact point 39 between the picker roller 32 and the retard roller 36. Due to frictional engagement between the outer circumferential surface 33 of the picker roller 32 and the outer circumferential surface 37 of the retard roller 36, the end sheet 21 continues to be transported towards the downstream end 14 along the document feed path 16 for further handling and processing downstream of the picker mechanism 30. The cooperation among the pre-picker roller 40, the picker roller 32, and the retard roller 36 to pick the end sheet 21 from the stack 20 of documents and then to transport the picked sheet downstream is conventional and known and, therefore, will not be described. When the end sheet 21 is picked and transported downstream, the sheet which was previously adjacent to the end sheet just picked and transported downstream moves into the document feeding path 16 to become the next end sheet to be picked and transported downstream.

In accordance with the present invention, a first interruptive sensor 60 and a second interruptive sensor 62 are located in the vicinity of the free end 46 of the arm member 44, as shown in FIG. 1. The sensors 60, 62 provide output signals on lines 61, 63, respectively. A controller 70 processes the signals on lines 61, 63 from the sensors 60, 62 and provides a control signal on line 71 in response to the signals on lines 61, 63 to control a tray motivator 74 which is disposed in the document feeder tray 18. The tray motivator 74 is a plate-like device which is controlled by the signal on line 71 from the controller 70 to apply a force against the stack 20 of documents to push the stack towards the pre-picker roller 40 to allow the pre-picker roller to pick and transport the end sheet 21 of the stack 20 along the document feeding path 16 as previously described. More specifically, the controller 70 controls the tray motivator 74 such that the stack 20 of documents contained in the tray 18 applies a relatively constant force against the outer circumferential surface 41 of the pre-picker roller 40.

When the stack 20 of documents applies a desired amount of force against the outer circumferential surface 41 of the pre-picker roller 40, such as shown in FIG. 1, the free end 46 of the arm member 44 is in a position which interrupts only the first sensor 60. When the first sensor 60 is interrupted, the first sensor provides a signal on line 61 indicative thereof. At the same time, the second sensor 62 provides a signal on line 63 indicative of the second sensor being uninterrupted. In response to these signals on lines 61, 63 from the sensors 60, 62, respectively, the controller 70 provides control signal on line 71 to control the tray motivator 74 such that the free end 46 of the arm member 44 continues to be maintained in the position as shown in FIG. 1.

Figure 2:
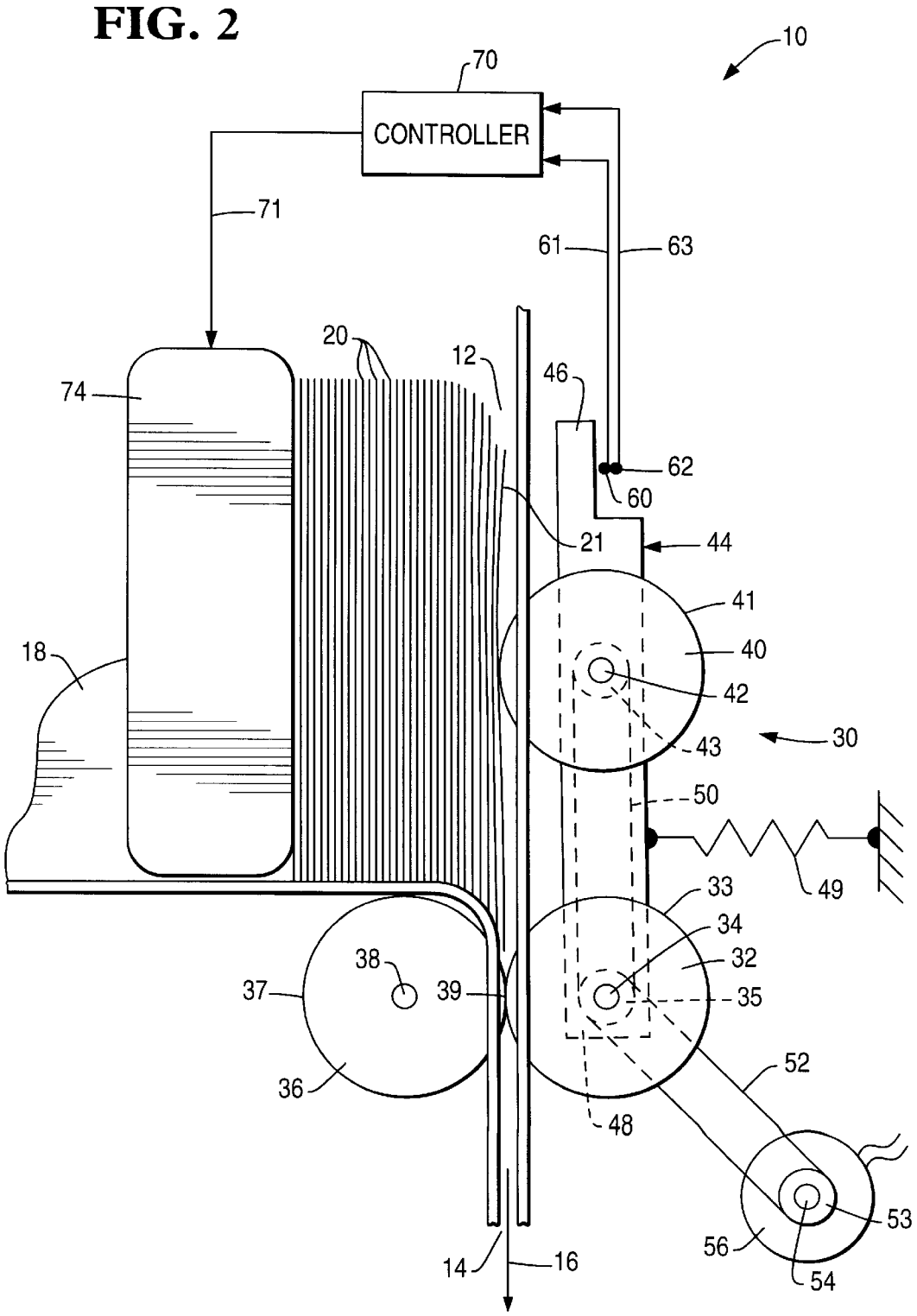
FIGS. 2 and 3 are views similar to FIG. 1 and showing parts in different positions.

If the stack 20 of documents applies an amount of force less than a desired amount force against the outer circumferential surface 41 of the pre-picker roller 40, then the arm member 44 moves to a position in which both sensors 60, 62 are uninterrupted, as shown in FIG. 2. The first and second sensors 60,62 provide signals on lines 61, 63, respectively, indicative of both sensors being uninterrupted. In response to these signals on lines 61,63 from the sensors 60, 62, respectively, the controller 70 provides control signal on line 71 to control the tray motivator 74 such that the tray motivator applies a greater amount of force against the stack 20 of documents. Accordingly, the stack 20 of documents applies a greater amount of force against the outer circumferential surface 41 of the pre-picker roller 40 to move the arm member 44 from the position shown in FIG. 2 back to the position shown in FIG. 1.

Figure 3:
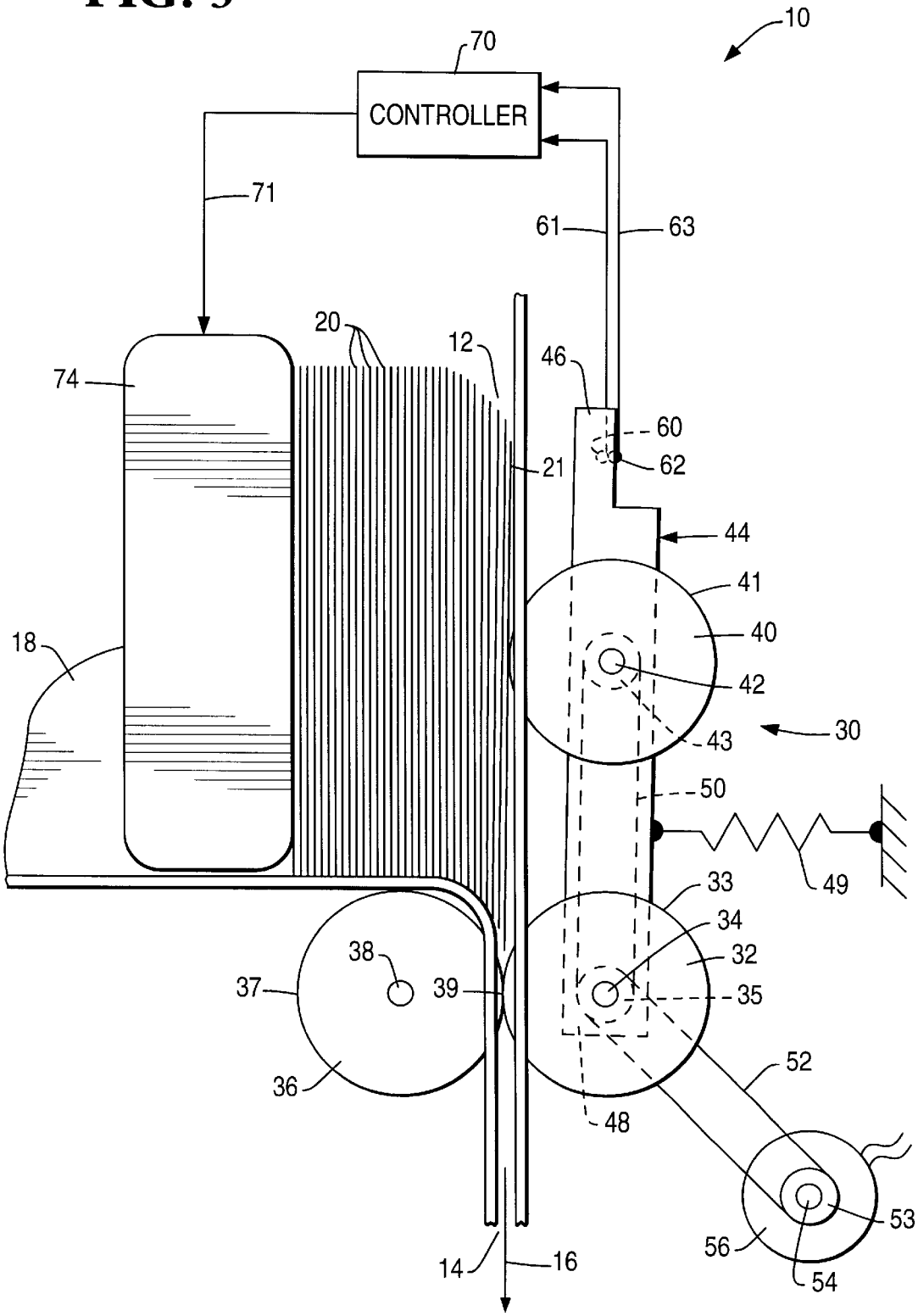

If the stack 20 of documents applies an amount of force greater than a desired amount force against the outer circumferential surface 41 of the pre-picker roller 40, then the arm member 44 moves to a position in which both sensors 60, 62 are interrupted, as shown in FIG. 3. The first and second sensors 60,62 provide signals on lines 61, 63, respectively, indicative of both sensors being interrupted. In response to these signals on lines 61,63 from the sensors 60, 62, respectively, the controller 70 provides control signal on line 71 to control the tray motivator 74 such that the tray motivator applies a lesser amount of force against the stack 20 of documents. Accordingly, the stack 20 of documents applies a lesser amount of force against the outer circumferential surface 41 of the pre-picker roller 40. This lesser amount of force allows the arm member 44 to move under the biasing force of the spring 49 from the position shown in FIG. 3 back to the position shown in FIG. 1.

A number of advantages result by controlling the tray motivator 74 to apply a force against the stack 20 of documents such that the stack applies a relatively constant force against the outer circumferential surface 41 of the pre-picker roller 40 in accordance with the present invention. One advantage is that document misfeeds are minimized. For example, a no-feed condition (i.e., no document is being fed) caused by an insufficient amount of force being applied by the stack 20 against the outer circumferential surface 41 of the pre-picker roller 40 is eliminated or at least minimized. Also, a no-feed condition caused by an excess amount of force being applied by the stack 20 against the outer circumferential surface 41 of the pre-picker roller 40 is eliminated or at least minimized. Another advantage is that the tendency of a sheet to skew is minimized as that sheet is being picked from the stack 20 and transported downstream along the document feeding path 16.

From the above description of the invention, those skilled in the art to which the present invention relates will perceive improvements, changes and modifications. Numerous substitutions and modifications can be undertaken without departing from the true spirit and scope of the invention. Such improvements, changes and modifications within the skill of the art to which the present invention relates are intended to be covered by the appended claims.

What is claimed is:

1. A document feeder for feeding documents along a document feed path, the document feeder comprising:

a tray for containing a stack of documents to be fed along the document feed path;

a picker mechanism for picking a document from the stack of documents stored in the tray and moving the picked document along the document feed path;

sensing means including a pair of interruptive sensors for sensing position of the picking mechanism relative to the stack of documents; and control means including (i) a tray motivator for applying a force against the stack of documents, and (ii) a controller for controlling the tray motivator to apply a first amount of force against the stack when only one interruptive sensor is interrupted, and a second amount of force which is different from the first amount of force against the stack when both interruptive sensors are interrupted.

2. A document feeder according to claim 1, wherein one interruptive sensor is interrupted and the other interruptive sensor is uninterrupted when the stack applies a desired amount of force against the picker mechanism.

3. A document feeder according to claim 1, wherein the picker mechanism includes a pre-picker roller having a longitudinal central axis and an outer circumferential surface which engages a document in the stack of documents to initially pick the engaged document and move the picked document into the document feed path as the pre-picker roller rotates about its longitudinal central axis.

4. A document feeder according to claim 3, wherein the picker mechanism includes a picker roller having a longitudinal central axis and an outer circumferential surface which engages a document which has been picked and moved into the document feed path by the pre-picker roller.

5. A document feeder for feeding documents along a document feed path, the document feeder comprising:

a tray for containing a stack of documents to be fed along the document feed path;

a picker mechanism for picking a document from the stack of documents stored in the tray and moving the picked document along the document feed path;

a controllable motivator disposed in the tray for, when controlled, applying a variable force against the stack of documents to move the stack against the picker mechanism to allow the picker mechanism to pick a document from the stack and move the picked document along the document feed path;

first and second interruptive sensors which cooperate to sense position of the picking mechanism relative to the stack-of documents; and a controller responsive to output signals from the first and second sensors for controlling the motivator to apply a first amount of force against the stack when only one interruptive sensor is interrupted, and a second amount of force which is different from the first amount of force against the stack when both interruptive sensors are interrupted.

6. A document feeder according to claim 5, wherein one interruptive sensor is interrupted and the other interruptive sensor is uninterrupted when the stack applies a desired amount of force against the picker mechanism.

7. A document feeder according to claim 5, wherein the picker mechanism includes a pre-picker roller having a longitudinal central axis and an outer circumferential surface which engages a document in the stack of documents to initially pick the engaged document and move the picked document into the document feed path as the pre-picker roller rotates about its longitudinal central axis.

8. A document feeder according to claim 7, wherein the picker mechanism includes a picker roller having a longitudinal central axis and an outer circumferential surface which engages a document which has been picked and moved into the document feed path by the pre-picker roller.

9. A document feeder for feeding documents along a document feed path, the document feeder comprising:

a tray for containing a stack of documents to be fed along the document feed path;

a picker mechanism for picking a document from the stack of documents stored in the tray and moving the picked document along the document feed path;

sensing means for sensing position of the picking mechanism relative to the stack of documents; and control means responsive to the sensing means for applying a force against the stack of documents such that the stack applies a relatively constant force against the picker mechanism as the picker mechanism picks documents from the stack and moves picked documents along the document feed path;

the sensing means including a pair of interruptive sensors which cooperate to sense position of the picking mechanism relative to the stack of documents such that (i) both interruptive sensors are uninterrupted when the stack applies an amount of force less than a desired amount of force against the picker mechanism, (ii) one interruptive sensor is interrupted and the other interruptive sensor is uninterrupted when the stack applies a desired amount of force against the picker mechanism, and (iii) both interruptive sensors are interrupted when the stack applies an amount of force greater than a desired amount of force against the picker mechanism.

10. A document feeder according to claim 9, wherein the control means includes (i) a tray motivator for applying a force against the stack, and (ii) a controller for controlling the tray motivator to apply a force against the stack which varies as a function of the number of interruptive sensors interrupted.

11. A document feeder for feeding documents along a document feed path, the document feeder comprising:

a tray for containing a stack of documents to be fed along the document feed path;

a picker mechanism for picking a document from the stack of documents stored in the tray and moving the picked document along the document feed path;

a controllable motivator disposed in the tray for, when controlled, applying a variable force against the stack of documents to move the stack against the picker mechanism to allow the picker mechanism to pick a document from the stack and move the picked document along the document feed path;

first and second interruptive sensors which cooperate to sense position of the picking mechanism relative to the stack of documents such that (i) both interruptive sensors are uninterrupted when the stack applies an amount of force less than a desired amount of force against the picker mechanism, (ii) one interruptive sensor is interrupted and the other interruptive sensor is uninterrupted when the stack applies a desired amount of force against the picker mechanism, and (iii) both interruptive sensors are interrupted when the stack applies an amount of force greater than a desired amount of force against the picker mechanism; and a controller responsive to output signals from the first and second sensors for controlling the motivator to apply a force against the stack of documents such that the stack applies a relatively constant force against the picker mechanism as the picker mechanism picks documents from the stack and moves picked documents along the document feed path.

* * * * *